US008170458B2

(12) United States Patent
Nakahara et al.

(10) Patent No.: US 8,170,458 B2
(45) Date of Patent: May 1, 2012

(54) IMAGE HEATING APPARATUS HAVING STABLY POSITIONED HEATING UNIT

(75) Inventors: Hisashi Nakahara, Numazu (JP); Goichi Kitadai, Suntou-gun (JP); Yoshihiro Matsuo, Susono (JP); Yoji Tomoyuki, Tokyo (JP); Takahiro Uchiyama, Mishima (JP); Koji Uchiyama, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 251 days.

(21) Appl. No.: 12/512,946

(22) Filed: Jul. 30, 2009

(65) Prior Publication Data

US 2010/0028062 A1 Feb. 4, 2010

(30) Foreign Application Priority Data

Jul. 31, 2008 (JP) ..... 2008-198369

(51) Int. Cl.
*G03G 15/20* (2006.01)

(52) U.S. Cl. ..... 399/329; 399/122

(58) Field of Classification Search ..... 399/122, 399/329; 430/124.3
See application file for complete search history.

(56) References Cited

U.S. PATENT DOCUMENTS

2006/0133868 A1 6/2006 Kobayashi

FOREIGN PATENT DOCUMENTS

| | | |
|---|---|---|
| JP | 2001-100556 | 4/2001 |
| JP | 2002-231434 | 8/2002 |
| JP | 2003-122147 | 4/2003 |
| JP | 2006-171630 | 6/2006 |

*Primary Examiner* — David Gray
*Assistant Examiner* — Ruth Labombard
(74) *Attorney, Agent, or Firm* — Canon USA Inc IP Division

(57) ABSTRACT

The present invention relates to an image heating apparatus in which a nip portion is formed by a heating unit, which includes a flexible sleeve and a heater, and a pressure roller. The position of the heating unit is appropriately maintained by pressing the heating unit against the pressure roller using a pressure member so that the heating unit can contact two or more portions of a downstream side rim of a groove arranged on a frame that holds the heating unit, even when the pressure roller is rotated.

3 Claims, 15 Drawing Sheets

IMAGE HEATING APPARATUS HAVING STABLY POSITIONED HEATING UNIT

BACKGROUND OF THE INVENTION

1. Field of the Invention

The present invention relates to an image heating apparatus for heating a toner image formed on a material to be heated by applying an appropriate image forming process, such as an electrophotographic process, an electrostatic recording process, a magnetic recording process or the like, to an image bearing member, such as an electrophotographic photosensitive member, an electrostatic recording dielectric member, a magnetic recording magnetic member or the like.

2. Description of the Related Art

A film type fixing apparatus having a heater, a flexible sleeve that moves in contact with the heater, and a pressure roller (i.e., elastic roller) that forms a fixing nip in cooperation with the heater via the flexible sleeve is known as an image heating apparatus mounted in an electrophotographic type copying machine or printer.

This film type fixing apparatus heat-fixes an unfixed toner image onto a recording material by transferring and heating the recording material to be heated, which bears the unfixed toner image and is nipped at a fixing nip, as discussed in, e.g., Japanese Patent Application Laid-Open Nos. 2006-171630, 2001-100556, and 2003-122147.

The time required for the fixing apparatus to reach a fixable temperature is comparatively short since energization of the heater is started. Accordingly, a first printout time (FPOT) by a printer with this fixing apparatus to output a first image after input of a print command is short. Thus, this printer has an advantage in low power consumption during a waiting time for a print command.

FIGS. 14 and 15 illustrate a conventional film-type fixing apparatus. FIGS. 14 and 15 are respectively a perspective view and a side view each illustrating a pressure unit for pressurizing a heater against a pressure roller to form a fixing nip. FIG. 14 illustrates one longitudinal end side of the fixing apparatus. The one longitudinal end side and the other longitudinal end side of the fixing apparatus are configured to respectively have shapes that are substantially symmetrical with respect to a plane perpendicular to the longitudinal direction thereof. Thus, drawing of the other longitudinal end side thereof is omitted. The "longitudinal direction" thereof is defined as a direction perpendicular to a recording material conveying direction in a recording material surface.

This fixing apparatus has a heating unit 126, a pressure roller 118 serving as a press-contact member in press-contact with the heating unit 126, and a fixing frame 121 serving as a holding member for holding the heating unit 126 and the pressure roller 118. A pressure plate 124 and a pressure spring 125 for pressing the heating unit 126 (pressure members) are provided in this fixing apparatus.

The heating unit 126 has a heater 115 serving as a heating element, a heater holder 117 serving as a heating element support member, and a fixing film 116 serving as a flexible sleeve that moves in contact with the heater 115. A fixing stay 119 is provided on one side of the heater holder 117, which is opposite to the side on which a heater element is held.

A flange 120 for regulating a longitudinal position of the fixing film 116 is provided at a longitudinal end portion of the fixing stay 119. The heating unit 126 is loosely and movably inserted into a guide groove 122 provided in the fixing frame 121.

The pressure roller 118 is axially supported by a bearing 123 mounted in the fixing frame 121. The pressure plate 124 acts as a lever and presses the heating unit 126 against the pressure roller 118 along the guide groove 122 provided in the fixing frame 121.

That is, one end 124*a* of the pressure plate 124 is passed through a hole 121*b* provided in a bent part 121*a* of the fixing frame 121 and serves as a fulcrum. The other end 124*b* serves as a force application point by arranging the compressed pressure spring 125 between the end 124*b* and the bent part 121*c* of the fixing frame 121.

An intermediate part of the pressure plate 124 act as a lever and presses a pressure portion 120*c* provided in the flange 120, so that the pressure portion 120*c* serves as a working point.

With the above pressurization configuration, a fixing nip N is constituted by the heater 115 and the pressure roller 118 via the fixing film 116.

The heating unit 126 is held by fitting the heater holder 117, which is located at the pressure roller 118 side with respect to the heating unit 126, and the flange 120 located at the other side, which is away from the pressure roller 128, into the guide groove 122 provided in the fixing frame 121.

That is, lower fitting portions 117*a* and 117*b* each for regulating a lower position of the heating unit 126 are provided at both ends of the heater holder 117. Upper fitting portions 120*a* and 120*b* each for regulating an upper position of the heating unit 126 are provided at both ends of the flange 120.

The heating unit 126 is held at the fixing frame 121 by inserting the lower fitting portions 117*a* and 117*b* and the upper fitting portions 120*a* and 120*b* into rims 122*a* and 122*b* respectively formed in both side edges of the guide groove 122.

In consideration of component dimension tolerances and component thermal expansion, the width of the guide groove 122 is set to be wider than each of the width between the lower fitting portions 117*a* and 117*b* and the width between the upper fitting portions 120*a* and 120*b* of the heating unit 126. In addition, a gap is provided between the guide groove 122 of the fixing frame 121 and each of the fitting portions of the heating unit 126.

The width of the guide groove 122 is equal to the span between the guide groove rim 122*a* at the downstream side in the recording material conveying direction and the guide groove rim 122*b* at the upstream side in the recording material conveying direction. Hereinafter, the "downstream side in the recording material conveying direction" and the "upstream side in the recording material conveying direction" are referred to simply as the "downstream side" and the "upstream side", respectively.

The width between the upper fitting portions of the heating unit 126 is equal to the span between the downstream side opposite surface 120*a* and the upstream side opposite surface 120*b* of the flange portion 120 located at an upper side of the heating unit 126.

The width between the lower fitting portions of the heating unit 126 is equal to the span between the downstream side opposite surface 117*a* and the upstream side opposite surface 117*b* of the heater holder 117.

Next, a position of the heating unit in the guide groove 122 with a gap is described below. FIG. 15 illustrates external forces acting on the heating unit 126 except the fixing film 116. Symbols used in FIG. 15 represent the following elements.

P: force with which the pressure plate 124 presses the pressure portion 120*c* of the flange 120.

$N_z$: drag (normal force) applied from the pressure roller 118.

F: drag (normal force) received at the downstream side opposite surface 117*a* of the lower fitting portion of the heating unit 126 from the downstream side rim 122*a* of the guide groove 122 (if F<0, drag (normal force) received by the upstream side opposite surface 117*b* of the lower fitting portion of the heating unit 126 from the upstream side rim 122*b* of the guide groove 122).

G: drag (normal force) received at the downstream side opposite surface 120*a* of the upper fitting portion of the heating unit 126 from the downstream side rim 122*a* of the guide groove 122 (if G<0 drag (normal force) received by the upstream side opposite surface 117*b* of the lower fitting portion of the heating unit 126 from the upstream side rim 122*b* of the guide groove 122).

μ: friction coefficient between the fixing film 116 and the heater 115.

a: distance from a fixing nip surface to each of the lower fitting portions 117*a* and 117*b* of the heating unit 126.

b: distance from the fixing nip surface to each of the upper fitting portions 120*a* and 120*b* of the heating unit 126.

A balance equation of force acting in a z-direction (direction parallel to the guide groove), a balance equation of force acting in a y-direction (direction perpendicular to the guide groove), and a balance equation of rotation moment around a point (fixing nip center) O are as follows.

Force acting in the $z$-direction: $P=N_z$

Force acting in the $y$-direction: $F+G=\mu N_z$

Rotation moment around the point $O$: $aF+bG=0$

According to the above three equations, when the pressure roller rotates in a direction in which a recording material is conveyed, the drags (normal forces) F and G are given as follows.

$$F=\mu bP/(a+b)>0$$

$$G=-\mu aP/(a+b)<0$$

That is, a lower part of the heating unit 126 abuts against the downstream side rim of the guide groove 122, while an upper part of the heating unit 126 abuts against the upstream side rim of the guide groove 122. Thus, the heating unit 126 is tilted in the guide groove 122.

In this case, the position of the heating unit 126 is affected by the span between the fitting portions of the heating unit, the span of the guide groove in various dimensions thereof.

In a case where dimensions of many types of components of the heating unit 126 affect the position thereof, the position of the heating unit 126 can be changed as much as the tolerances of the dimensions. When the position of the heating unit 126 is changed, the relative position of the heater 115 with respect to the fixing nip N may be changed.

Consequently, sometimes, a heat distribution in the fixing nip N changes, so that a fixing failure and an image defect, such as a cold offset or a hot offset, may occur, as discussed in Japanese Patent Application Laid-Open No. 2006-171630.

SUMMARY OF THE INVENTION

The present invention is directed to an image heating apparatus capable of maintaining an appropriate position of a heating unit even when a pressure roller rotates.

According to an aspect of the present invention, an image heating apparatus for heating a recording material that bears a toner image includes a heating unit including a flexible sleeve configured to contact the toner image, and a heater configured to be in contact with an inner surface of the sleeve, a pressure roller forming a nip portion that sandwiches and conveys the recording material, in cooperation with the heater via the sleeve, a frame configured to hold the heating unit and the pressure roller, and including a guide groove that guides the heating unit towards the pressure roller held by the frame, wherein the guide groove guides each of fitting portions respectively provided at both ends of the heating unit along a rim of the guide groove and a pressure member configured to press the heating unit against the pressure roller, wherein a width of the guide groove in a recording material conveying direction is wider than that of each of the fitting portions in the recording material conveying direction, and wherein rotation moment whose magnitude is larger than that of rotation moment generated in the heating unit by rotation of the pressure roller in a direction, in which the recording material is conveyed, is applied to the heating unit by the pressure member in a direction, in which the rotation moment generated by rotation of the pressure roller is cancelled, so that even when the rotation moment is generated by the rotation of the pressure roller, at least two points in a region of the fitting portions opposed to a downstream side rim in the recording material conveying direction of the guide groove abut against the downstream side rim.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

Figure 1:
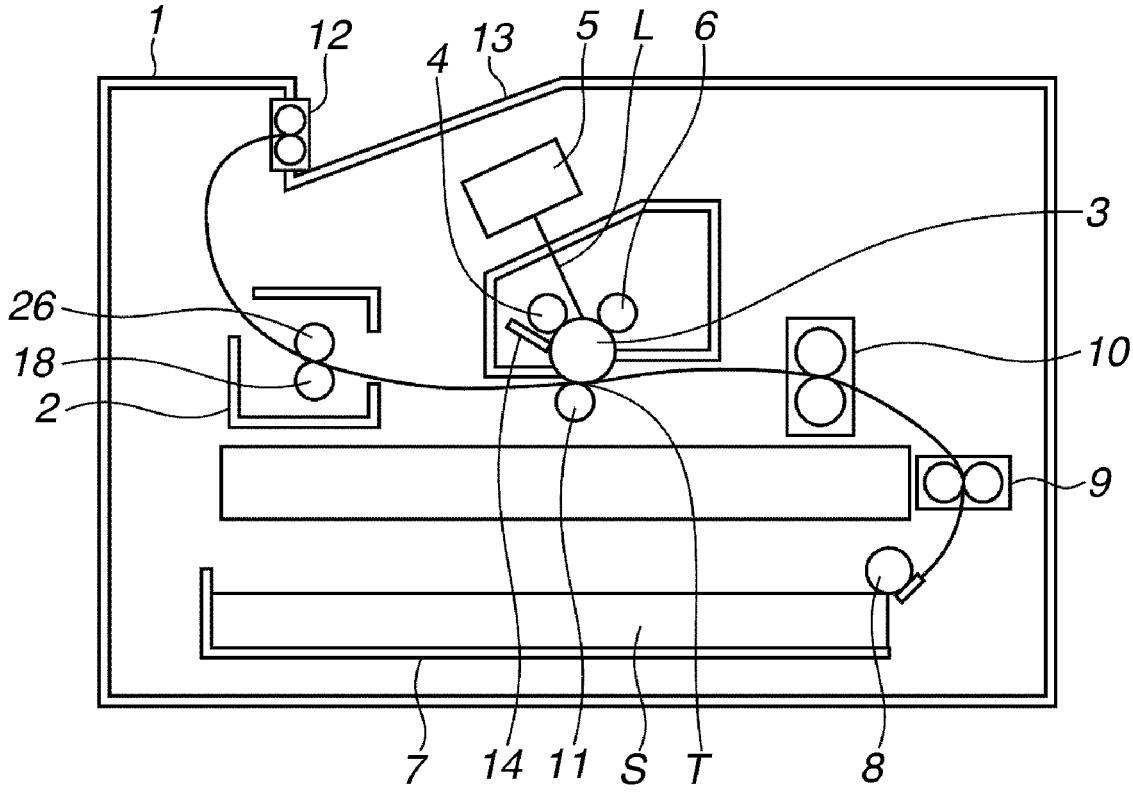
FIG. 1 is a longitudinally cross-sectional view of an image forming apparatus including an example heating fixing apparatus according to the present invention.

FIG. 1 is a longitudinally cross-sectional view of an image forming apparatus including an example heating fixing apparatus according to the present invention. This image forming apparatus is a transfer type laser beam printer electrophotographic process. A photosensitive drum 3 is a rotary drum-shaped photosensitive member serving as an image bearing member in which a photosensitive member such as an organic photosensitive compound (OPC) or amorphous silicon is formed on a cylindrical substrate made of aluminum, nickel or the like. The photosensitive drum 3 rotates clockwise at predetermined peripheral speed.

An outer peripheral surface (outer surface) of the photosensitive drum 3 is uniformly charged, during rotation thereof, by a charging roller 4 serving as a charging unit. The charged photosensitive drum 3 is exposed by laser light L output from a laser beam scanner 5 serving as an image exposure unit, so that an electrostatic latent image is formed. This electrostatic latent image is developed by a developing apparatus 6 as an image formed by toner serving as a developer.

Recording materials S serving as materials to be heated are separated and fed one by one from a feeding cassette 7 by a feeding roller 8. Then, the recording materials S are fed to a registration roller pair 10 via a conveying roller pair 9. The registration roller pair 10 conveys each recording material S to a transfer nip T in synchronization with a toner image formed on the photosensitive drum 3 in order to arrange a toner image at a predetermined position in the conveying direction thereon.

The recording material S is nipped by the transfer nip T. Then, the recording material S is conveyed to the heating fixing apparatus 2 while the toner image formed on the photosensitive drum 3 is transferred thereonto by a transfer roller to which a transfer bias having a polarity opposite to that of the toner is applied. The toner image is heat-fixed onto the recording material S by the heating fixing apparatus 2. Then, the recording material S is discharged onto a discharge tray 13 via a discharge roller pair 12.

Figure 2:
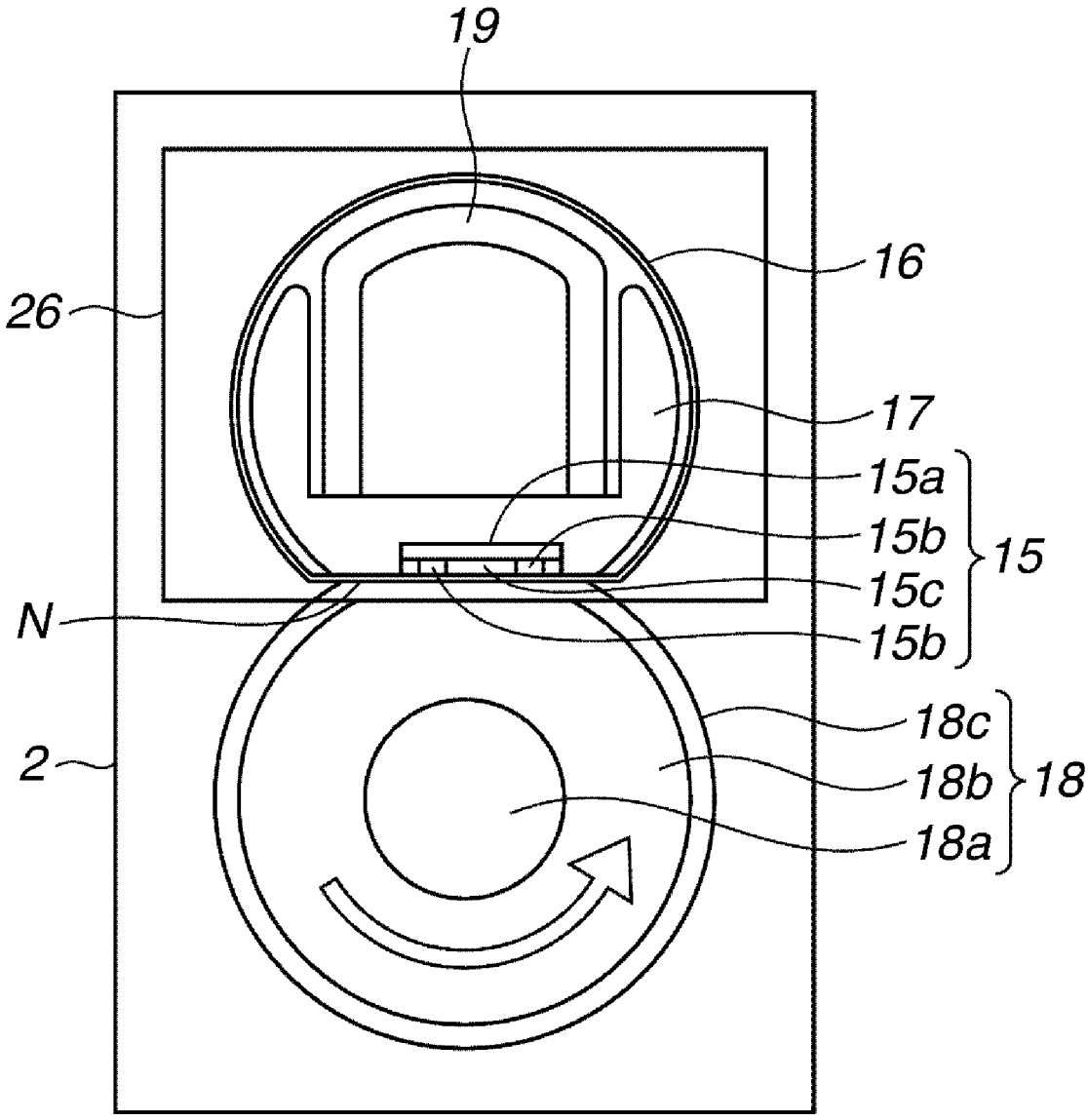
FIG. 2 is a longitudinally cross-sectional view of the heating fixing apparatus illustrated in FIG. 1.

FIG. 2 illustrates the heating fixing apparatus 2 illustrated in FIG. 1 by extracting the heating fixing apparatus 2 therefrom. The heating fixing apparatus 2 has a heating unit 26, a pressure roller 18 serving as a press-contact member to be in press-contact with the heating unit 26, and a fixing frame 21 serving as a holding member for holding the heating unit 26 and the pressure roller 18.

The heating unit 26 includes a heater 15, a heater holder 17 serving as a heating element support member for supporting the heater 15, and a fixing film serving as a flexible sleeve that moves in contact with the heater 15.

Then, the recording material S serving as a material to be heated that bears an image is nipped and conveyed by a fixing nip N serving as a press-contact portion formed between the heating unit 26 and the pressure roller 18. Heat of the heater 15 is given via the fixing film 16 to the recording material S nipped and conveyed by the fixing nip N so as to melt the toner image. In addition, pressure is applied to the melted toner. Thus, the melted toner is fixed.

Hereinafter, each component is described in more detail.

1) Heater 15

The heater 15 includes a heat-resisting insulating substrate 15*a* having good thermal conductivity, a heating resistance element 15*b* formed and equipped on the fixing-film-side surface of the substrate 15*a*, and a heat-resisting overcoat 15*c* for protecting the substrate 15*a* and the heating resistance element 15*b*. According to the present exemplary embodiment, a material obtained by kneading silver, palladium, glass powder (an inorganic binding agent), and an organic binding agent is printed as the heating resistance element 15*b* on the substrate 15*a* made of alumina. In addition, glass is coated thereon as the heat-resisting overcoat 15*c*.

2) Fixing Film 16

A single layer film made of a heat-resisting material such as polytetrafluoroethylene (PTFE), perfluoroalkoxy (PFA), or tetrafluoroethylene-perfluoroalkyl-vinyl-ether (FEP), or a composite layer film obtained by coating an outer peripheral surface of a base layer made of polyimide, polyamide-imide, polyetheretherketone (PEEK), polyethersulfone (PES), polyphenylenesulfide (PPS), stainless steel (SUS) or the like with PTFE, PFA, FEP or the like is used as the fixing film 16. In order to balance heat capacity that affects quick-start ability with strength that prevents generation of a crack, a thickness of the fixing film 16 is usually set as being equal to or less than 100 μm, and being equal to or more than 20 μm. In the present exemplary embodiment, a film obtained by coating an outer peripheral surface of a polyimide film having a thickness of about 50 μm with PTFE is used as the fixing film 16. In addition, the fixing film 16 is provided around the heater holder 17 with a gap so that an inside diameter thereof is 18 mm, and that the inner peripheral length thereof is longer than the outer peripheral length of the heater holder 17.

3) Heater Holder 17

Highly heat-resisting resins, such as polyimide, polyamide, PEEK, PPS, and liquid crystal polymers, and composite materials of such resins and ceramics, metal, and glass are used as materials of the heater holder 17. The present exemplary embodiment uses a heater holder cross-sectionally tub-shaped by molding a liquid crystal polymer using a die.

4) Pressure Roller 18

The pressure roller 18 includes a core metal 18*a*, an elastic body layer 18*b* provided around the core metal 18, and a demolding layer 18*c* serving as an outermost layer provided around the elastic body layer 18*b*. According to the present exemplary embodiment, the core metal 18*a* is made of free-machining steel. The elastic body layer 18*b* is made of silicon rubber having a thickness of about 3 mm. The demolding layer 18*c* is formed of a PFA tube having a thickness of about 30 μm. The present exemplary embodiment uses the pressure roller 18 having an outside diameter of 20 mm.

Figure 3:
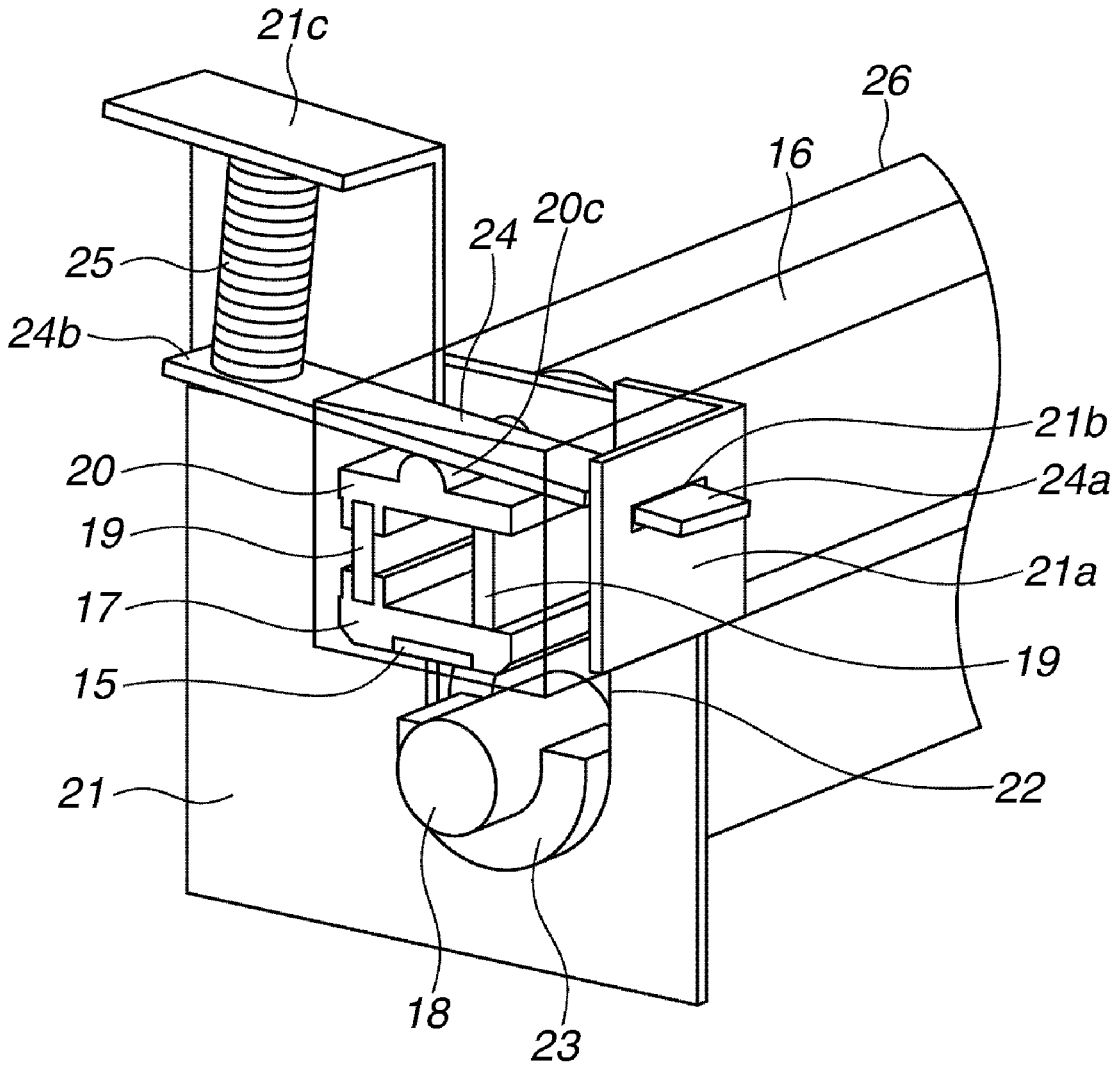
FIG. 3 is a perspective view illustrating the heating fixing apparatus illustrated in FIG. 2.
Figure 4:
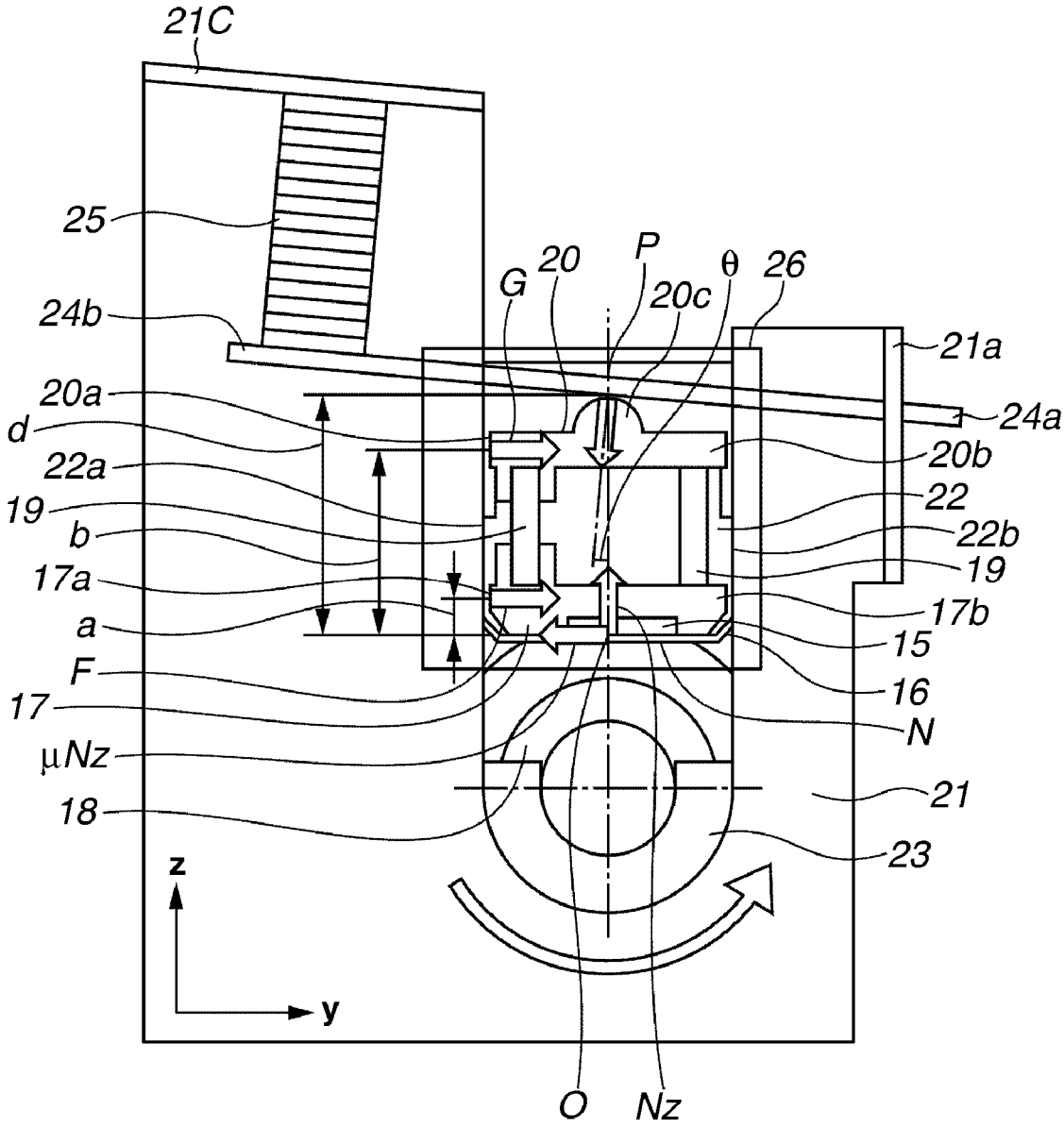
FIG. 4 is a side view of the fixing apparatus according to a first exemplary embodiment of the present invention.

FIGS. 3 and 4 are a perspective view and a side view of a pressure portion of the fixing apparatus according to the present exemplary embodiment, which presses the heater 15 against the pressure roller 18 in order to form the fixing nip N as a press-contact portion, respectively.

This perspective view (i.e., FIG. 3) illustrates one longitudinal end side. The one longitudinal end side and the other longitudinal end side of the fixing apparatus are configured to respectively have shapes that are substantially symmetrical with respect to a plane perpendicular to the longitudinal direction thereof. Thus, drawing of the other longitudinal end side thereof is omitted. The "longitudinal direction" thereof is defined as a direction perpendicular to a recording material conveying direction in a recording material surface.

The heating unit 26 includes a heater 15 serving as a heating element, a heater holder 17 serving as a heating element support member for supporting the heater 15, and a fixing film 116 serving as a flexible sleeve that moves in contact with the heater 15.

A fixing stay 19 is provided on one side of the heater holder 17, which is opposite to a heater mounting surface thereof. A flange 20 for regulating a longitudinal position of the fixing film 16 is provided at a longitudinal end portion of the fixing stay 119. The flange 20 is substantially equal to the heater holder 17 in width in the recording material conveying direction. The flange 20 is loosely and movably inserted into a guide groove 22 provided in the fixing frame 21.

An upstream side rim and a downstream side rim in the recording material conveying direction of the guide groove 22 of the fixing frame 21 respectively constitute rims 22*a* and 22*b* of the guide groove, along which the heating unit 26 is guided.

Each fitting portion (each lower fitting portion) of the heater holder 17 and each fitting portion (each upper fitting portion) of the flange 20 are inserted between the downstream side rim 22*a* and the upstream side rim 22*b* of the guide groove 22. Thus, the heating unit 26 is held by each fixing frame 21.

In other words, these two components, i.e., the heater holder 17 located at one side of the heating unit 26, which is at the side of the pressure roller 18, and the flange 20 located at the other side of the heating unit 26, which is placed away from a pressure roller 28, are inserted into the guide groove 22 and held by the rims of the guide groove 22.

A downstream side opposite surface 17*a* opposed to the downstream side rim 22*a* of the guide groove 22, and an upstream side opposite surface 17*b* opposed to the upstream side rim 22*b* of the guide groove 22 are provided at both ends in the longitudinal direction of the heater holder 17, respectively. A downstream side opposite surface 20*a* opposed to the downstream side rim 22*a* of the guide groove 22, and an upstream side opposite surface 20*b* opposed to the upstream side rim 22*b* of the guide groove 22 are provided at both longitudinal ends of the heating unit 26, respectively.

The downstream side opposite surface 17*a* and the downstream side opposite surface 20*a* are inserted into a ditch that is formed in an associated one of both side rims of the guide groove 22, i.e., in the downstream side rim 22*a* thereof. Simultaneously, the upstream side opposite surface 17*b* and the upstream side opposite surface 20*b* are inserted into a ditch that is formed in the other side rims of the guide groove 22, i.e., in the upstream side rim 22*b* thereof. Thus, the heating unit 26 is mounted in the guide groove 22.

The heating unit 26 is constructed to include a plurality of heating-unit-side fitting portions (the heater holder 17 and the flange 20), which are inserted into the guide groove 22.

In consideration of component dimension tolerances and component thermal expansion, the width of the guide groove 22 is set to be wider than that of each of the upper fitting portions (the flange 20) and the lower fitting portions (the heater holder 17). In addition, a gap is provided between the guide groove 22 of the fixing frame 21 and each of the fitting portions of the heating unit 26.

Incidentally, note that the expressions "downstream side" and "upstream side" represent the "downstream side in the recording material conveying direction" and the "upstream side in the recording material conveying direction", respectively. The width of the guide groove 22 is equal to the span between the downstream side rim 22*a* and the upstream side rim 22*b* in the recording material conveying direction thereof. The width between the upper fitting portions of the flange 20 of the heating unit 26 is equal to the span between the downstream side opposite surface 20*a* and the upstream side opposite surface 20*b* of the fitting portions of the flange 20.

On the other hand, the width between the lower fitting portions (the heater holder 17) of the heating unit 26 is equal to the span between the downstream side opposite surface 17*a* and the upstream side opposite surface 17*b* of the fitting portions of the heater holder 17.

Accordingly, there is a gap in the recording material conveying direction between the guide groove 22 and each of the heater holder 17 and the flange 20. Consequently, the position of the heating unit 26 is not determined only by fitting the heater holder 17 and the flange 20 into the ditches formed in the rims of the guide groove 22, respectively.

Thus, according to the present invention, the position of the heating unit 26 is held by abutting the heating unit 26 to only the downstream side rim 22*a* located at the downstream side in the recording material conveying direction from the rims 22*a* and 22*b* of the guide groove 22.

The fixing apparatus 2 includes a pressure plate 24 and a pressure spring 25, each of which serves as a pressure member for pressing the heating unit 26 against the pressure roller 18. The pressure roller 18 is axially supported by a bearing 23 attached to the fixing frame 21.

The pressure plate 24 acts as a lever and presses the heating unit 26 against the pressure roller 18 along the guide groove 22 provided in the fixing frame 21. That is, one end 24*a* of the pressure plate 24 is passed through a hole 21*b* provided in a bent part 21*a* of the fixing frame 21 and serves as a fulcrum. The other end 24*b* serves as a force application point by arranging a compressed pressure spring 25 between the end 24*b* and the bent part 21*c* of the fixing frame 21.

An intermediate portion of the pressure plate 24 presses a pressure portion 20*c* provided in the flange 20, so that the pressure portion 20*c* serves as a working point. A tension spring 25 can be applied as the pressure spring 25, instead of a compression spring used in the present exemplary embodiment.

With the above pressurization configuration, a fixing nip N is constituted by the heater 15 and the pressure roller 18 via the fixing film 16. A flange pressure portion 20*c* is a portion protruded like a circular-arc on a normal line perpendicular to a nip surface passing through the center of the fixing nip N (according to the present exemplary embodiment, the center of the pressure roller 18 is located on the normal line).

The direction of a normal line perpendicular to the pressure plate 24 at a contact point between the pressure plate 24 and the pressure portion 20*c* is angularly shifted by a predetermined angle θ towards a downstream side in the recording material conveying direction from the direction of the normal line perpendicular to the nip surface at the fixing nip N serving as the press-contact portion between the heating unit 26 and the pressure roller 18.

Next, the behavior of the position of the heating unit 26 in the guide groove 22 provided by interposing the gap between the guide groove 22 and each of the fitting portions of the heating unit 26 is described hereinafter.

Basically, in a state in which the heating unit 26 and the pressure roller 18 are driven, the heating unit 26 is locked only to the rim 22*a* of the guide groove 2, which is located at the downstream side in the recording material conveying direction thereof, according to the relationship among external forces acting on the heating unit 26. The external forces are described in detail hereinafter.

FIG. 4 illustrates the external forces acting on the heating unit 26 except the fixing film 16. Symbols used in FIG. 4 represent the following elements. The direction of a white arrow in FIG. 4 indicates the rotation direction of the pressure roller 18 while conveying the recording material (i.e., while performing fixing).

P: force with which the pressure plate 24 presses the pressure portion 20*c* of the flange 20. (normal line direction at the pressure point)

$N_z$: drag (normal force) applied from the pressure roller 118.

F: drag (normal force) received by the downstream side opposite surface 17*a* of the lower fitting portion of the heating unit 26 from the downstream side rim 22*a* of the guide groove 22 (if F<0, drag (normal force) received by the upstream side opposite surface 17*b* of the lower fitting portion of the heating unit 26 from the upstream side rim 22*b* of the guide groove 22).

G: drag (normal force) received by the downstream side opposite surface 20*a* of the upper fitting portion of the heating unit 26 from the downstream side rim 22*a* of the guide groove 22 (if G<0, drag (normal force) received by the upstream side opposite surface 17*b* of the lower fitting portion of the heating unit 26 from the upstream side rim 22*b* of the guide groove 22).

μ: friction coefficient between the fixing film 16 and the heater 15.

a: distance from a fixing nip surface N to each of the lower fitting portions 17*a* and 17*b* of the heating unit 26.

b: distance from the fixing nip surface N to each of the upper fitting portions 20*a* and 20*b* of the heating unit 26.

d: distance from the fixing nip surface N to the pressure portion 20*c*.

θ: angle formed between the normal line perpendicular to the pressure plate 24 at the contact point between the pressure plate 24 and the pressure portion 20*c* and the guide groove 22.

A balance equation of force acting in a z-direction (direction parallel to the guide groove 22), a balance equation of force acting in a y-direction (direction perpendicular to the guide groove 22), and a balance equation of rotation moment around a point (center of the fixing nip N) O are as follows.

Force acting in the $z$-direction: $P\cos\theta=N_z$

Force acting in the $y$-direction: $F+G=\mu N_z+P\sin\theta$

Rotation moment around the point $O$: $aF+bG=dP\sin\theta$

According to the above three equations, the drags (normal forces) F and G are obtained as follows.

$$F=P\{b(\sin\theta+\mu\cos\theta)-d\sin\theta\}/(b-a).$$

$$G=P\{d\sin\theta-a(\sin\theta+\mu\cos\theta)\}/(b-a).$$

In the present exemplary embodiment, a value of the friction coefficient μ is obtained by actual measurement. In addition, values of the distances a, b, and d and the angle θ are set so as to satisfy the following relationship thereamong, then F>0 and G>0 are satisfied.

$$b(\sin\theta+\mu\cos\theta)>d\sin\theta>a(\sin\theta+\mu\cos\theta).$$

That is, both of the downstream side opposite surface 17*a* of the lower fitting portion of the heating unit 26 and the downstream side opposite surface 20*a* of the upper fitting portion thereof abut against the downstream side rim 22*a* of the guide groove 22.

Accordingly, the position of the heating unit 26 is affected only by the dimensions of the downstream side opposite surface 17*a* of the lower fitting portion of the heating unit, the downstream side opposite surface 20*a* of the upper fitting portion thereof, and the downstream side rim 22*a* of the guide groove 22. Consequently, according to the present invention, a stable position of the heating unit 26 can be maintained.

Figure 5:
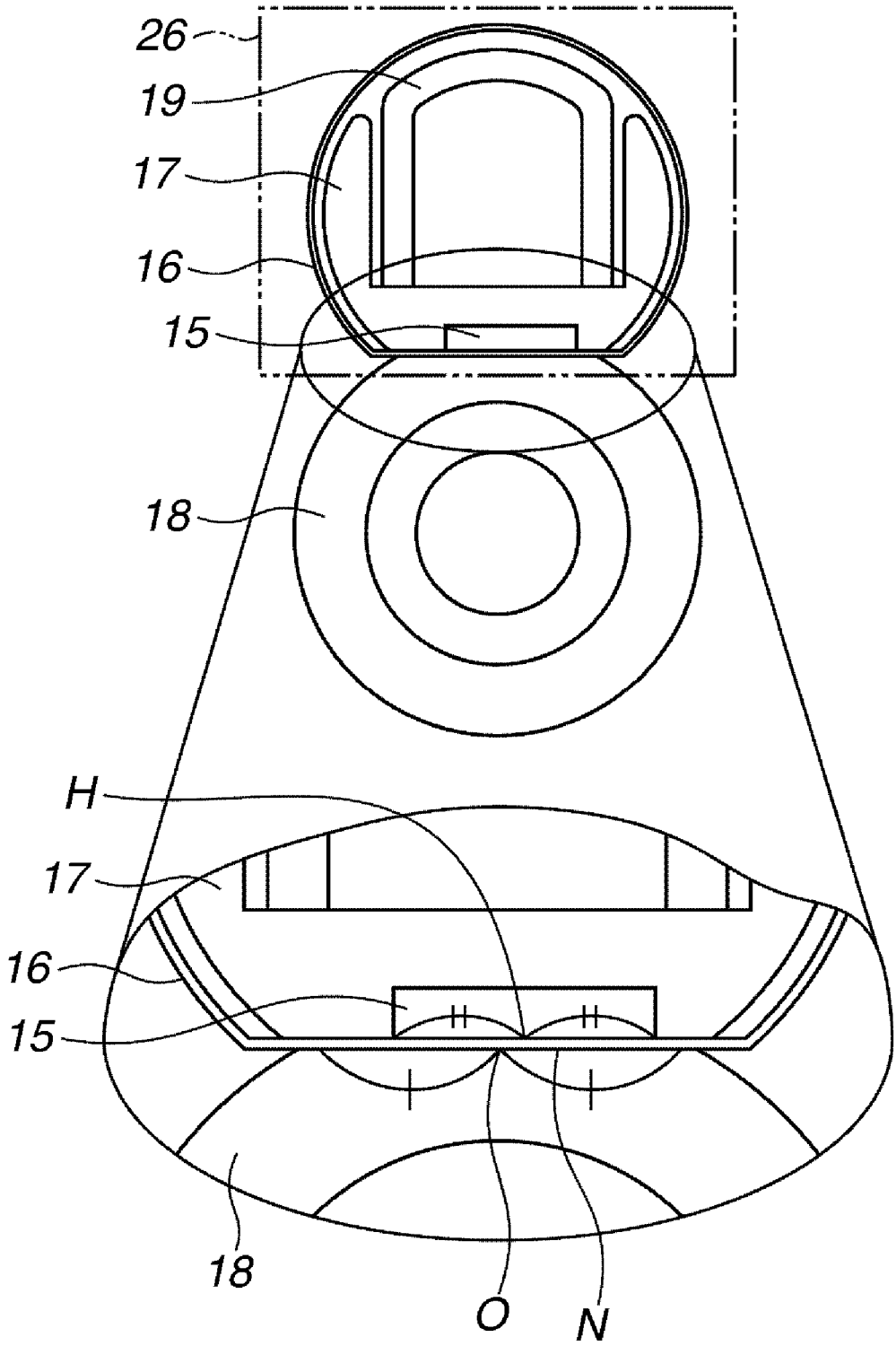
FIG. 5 illustrates a state of a fixing nip according to the first exemplary embodiment of the present invention.
Figure 6:
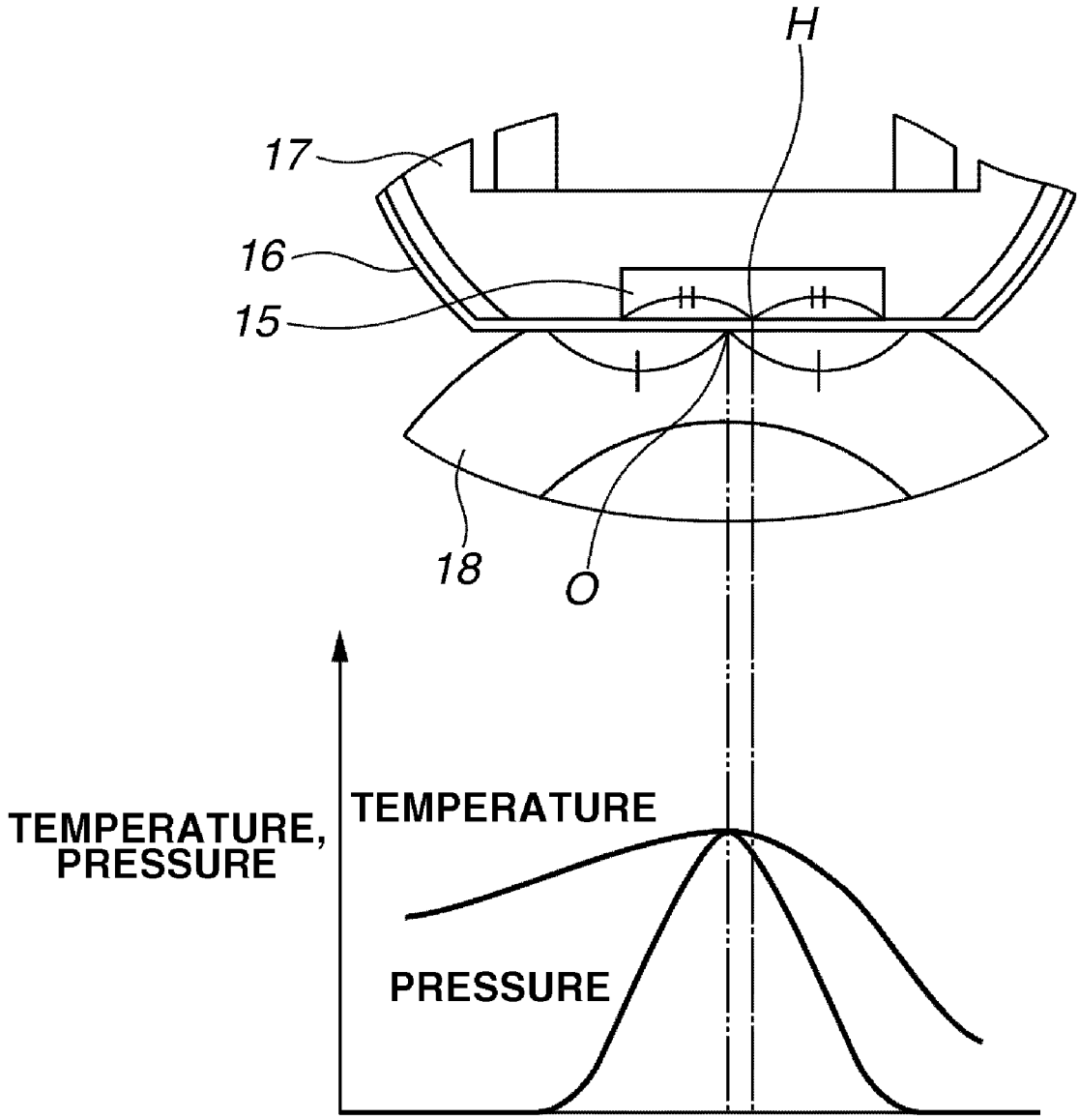
FIG. 6 illustrates distributions of temperature and pressure in the fixing nip according to the first exemplary embodiment of the present invention.
Figure 7:
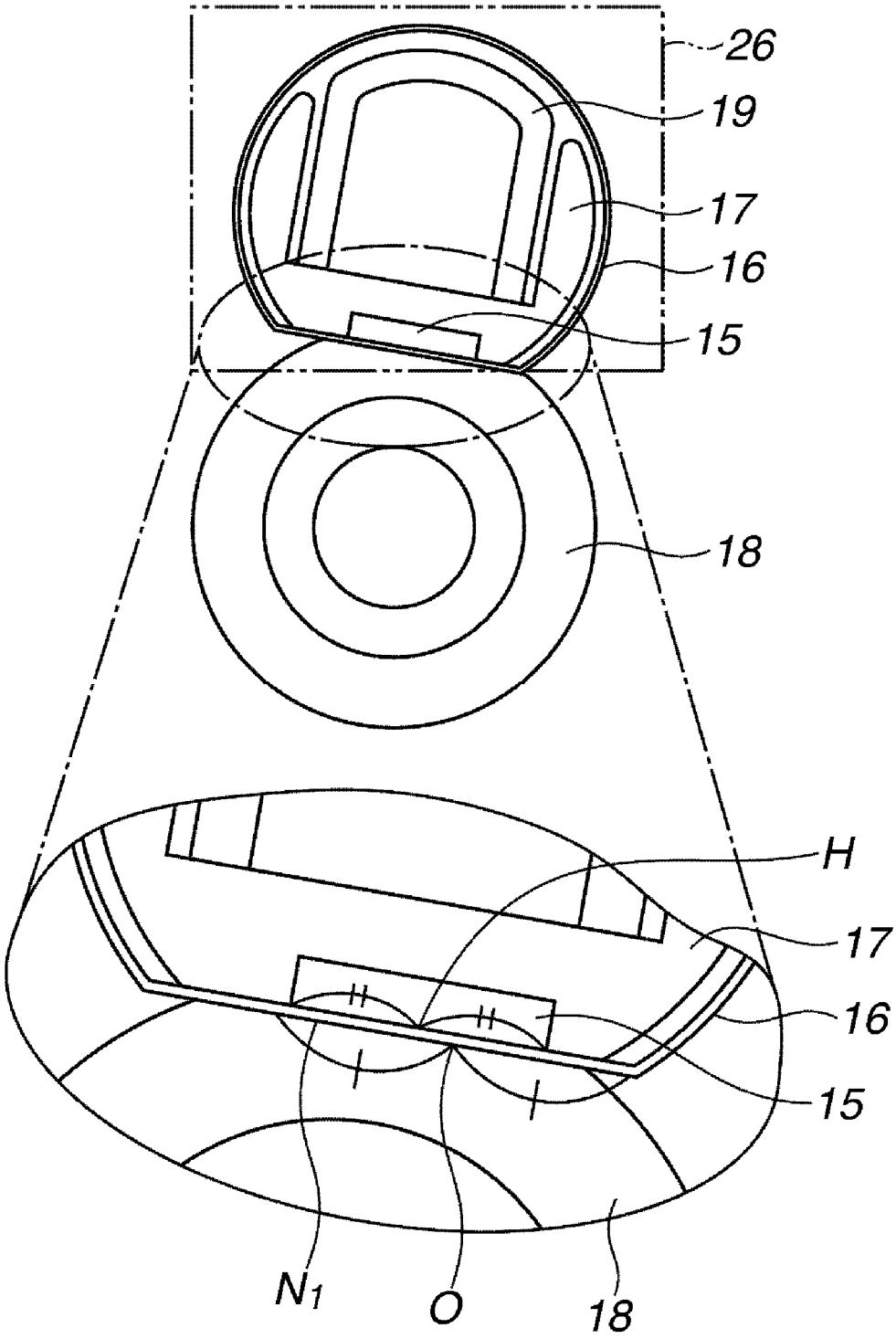
FIG. 7 illustrates a state of a fixing nip in which a heating unit is tilted, as compared with a heating unit of the fixing nip according to the present invention.
Figure 8:
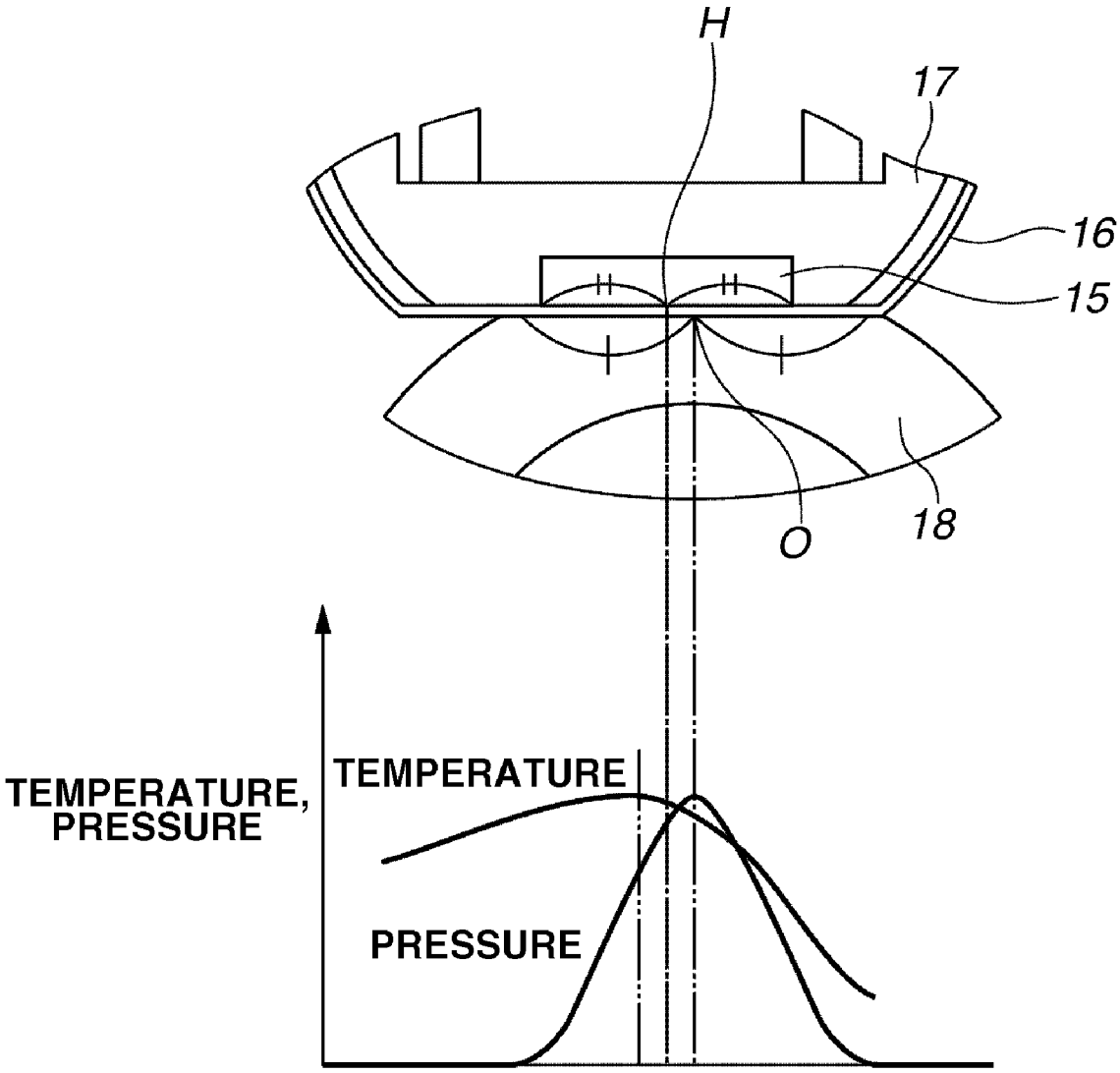
FIG. 8 illustrates distributions of temperature and pressure in the fixing nip in which the heating unit is tilted, as compared with the heating unit of the fixing nip according to the present invention.

FIG. 5 illustrates the relative positions of the fixing nip N and the heater 15 according to the present exemplary embodiment. FIG. 6 illustrates the distributions of temperature and pressure in the fixing nip N according to the present exemplary embodiment. FIG. 7 illustrates the relative positions of the fixing nip N and the heater 15 in a case where the heating unit 26 is tilted, as compared with those according to the present exemplary embodiment. FIG. 8 illustrates the distributions of temperature and pressure in the case illustrated in FIG. 7. For convenience of description, FIG. 8 illustrates a case where the fixing nip surface is turned so as to extend horizontally.

As is seen from FIGS. 6 and 8, the distribution of temperature in each of the fixing nips N and N1 has a peak at a position at the downstream side in the recording material conveying direction from the center H of the heater 15. This is because the fixing film 16 moves in the recording material conveying direction while heat of the heater 15 is transmitted to the outer surface of the fixing film 16 from the inner surface thereof. The distribution of pressure in each of the fixing nips N and N1 has a peak at the center O of the associated one of the fixing nips N and N1.

In the present exemplary embodiment, the center H of the heater 15 is shifted to the upstream side in the recording material conveying direction, which is the upstream side in a heated-material conveying direction, with respect to the center O of the nip N. Thus, as illustrated in FIG. 5, the position of the peak of the distribution of temperature in the fixing nip N is made closer to the position of the peak of the distribution of pressure therein.

When the heating unit 2 is tilted, as illustrated in FIG. 7, the relative positions of the center H of the heater 15 and the center O of the fixing nip N differ from those illustrated in FIG. 5 due to influence of the tilting of the heating unit 2. The center H of the heater 15 is shifted to the downstream side in the recording material conveying direction with respect to the center O of the nip N. Thus, as illustrated in FIG. 8, the position of the peak of the distribution of temperature in the fixing nip N is shifted from that of the peak of the distribution of pressure therein.

Next, fixability of the present exemplary embodiment, and that of the case where the heating unit is tilted, as illustrated in FIG. 7, are described hereinafter by making comparison therebetween with reference to a fixing mechanism illustrated in FIG. 9.

Figure 9:
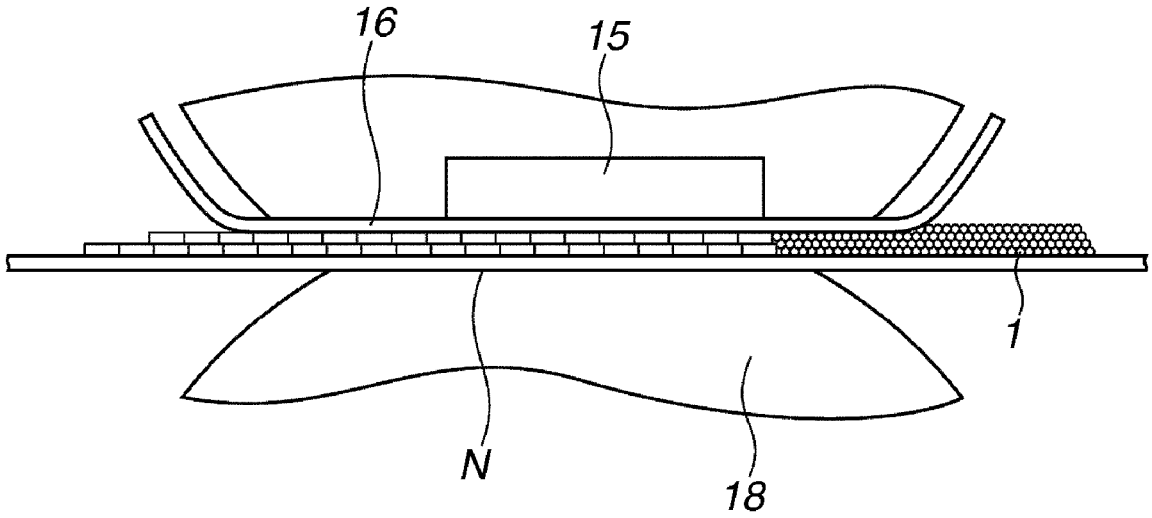
FIG. 9 illustrates a melted condition of toner in the fixing nip portion.

Referring to FIG. 9, unfixed toner t represented by elongated circles is in a dissolved state and has low viscosity. Unfixed toner t represented by circles is undissolved. FIG. 9 illustrates how the undissolved toner t is gradually dissolved by heat from the heater 15 of the fixing nip N.

When the peak of the distribution of temperature is close to that of the distribution of pressure, as illustrated in FIG. 6, the toner t is dissolved and fixed in a low viscosity condition. Thus, the fixability is good.

When the peak of the distribution of temperature is shifted to the downstream side in the recording material conveying direction from that of the distribution of pressure, as illustrated in FIG. 8, the toner t is fixed in a state in which the toner t is not completely dissolved. Thus, the fixability is degraded. When the fixability is poor, the unfixed toner adheres to the fixing film 16. Thus, a phenomenon called "cold offset" is caused, in which a toner image offset occurs with a rotational period of the fixing film 16.

On the other hand, when the temperature of the heater 15 is raised to a too high level, the viscosity of dissolved toner is too low. Thus, the dissolved toner adheres to the fixing film 15 without being held on the recording material. Consequently, sometimes, a phenomenon called "hot offset" is caused, in which a toner image offset occurs with a rotational period of the fixing film 15.

As described above, the position of the heating unit 26 affects the fixability. Thus, the position of the heating unit 26 affects the occurrence of a fixing failure and an image failure, such as the cold offset or the hot offset.

In the present exemplary embodiment, even when rotation moment is generated in the heating unit by rotation of the pressure roller 18, the heating unit contacts only the downstream side rim 22*a* without contacting the upstream side rim 22*b* of the guide groove 22. Accordingly, the position of the heating unit 26 is stabilized. Consequently, the image failure can be reduced.

Thus, the image heating apparatus is constructed such that even when rotation moment is generated in the heating unit 26 by rotation of the pressure roller 18 in the recording material conveying direction, at least two points 17*a* and 20*a* in a region of the fitting portions opposed to the downstream side rim 22*a* in the recording material conveying direction of the guide groove 22 abut against the downstream side rim 22*a* of the of the guide groove 22. Accordingly, rotation moment whose magnitude is larger than that of rotation moment generated in the heating unit 26 by rotation of the pressure roller 18 in a direction, in which the recording material is conveyed, is applied to the heating unit 26 by the pressure member 24 in a direction, in which the rotation moment generated by rotation of the pressure roller 18 is cancelled.

In the foregoing description of the present exemplary embodiment, a system of shifting the center of the heater 15 from that of the fixing nip N has been described by way of example. However, the position of the heating unit 26 can be stabilized by employing the pressing method according to the present exemplary embodiment even when the position of the center H of the heater 15 is in agreement with that of the center O of the fixing nip N.

Thus, according to the present exemplary embodiment, the influence, on the position of the heating unit 26, of the dimension tolerance of the heating unit 26 and the fixing frame 21 serving as the heating unit support member can be reduced. In addition, the position of the heating unit 26 can be stabilized.

Consequently, variation in the relative positions of the heater 15 and the fixing nip N of the heating unit 26 can be suppressed. In addition, fixing failures and image failures such as the cold offset and the hot offset, which occur due to such variation, can be reduced.

Next, a second exemplary embodiment of the present invention is described hereinafter. The present exemplary embodiment differs from the aforementioned first exemplary embodiment only in the pressure portion of the heating fixing apparatus. Therefore, only the difference between the first exemplary embodiment and the second exemplary embodiment is mainly described below. The rest of the configuration of the second exemplary embodiment is similar to that of the first exemplary embodiment. In addition, components of the second exemplary embodiment, which are similar to those of the first exemplary embodiment, are designated with the same reference numerals. Thus, description of such components is omitted.

Figure 10:
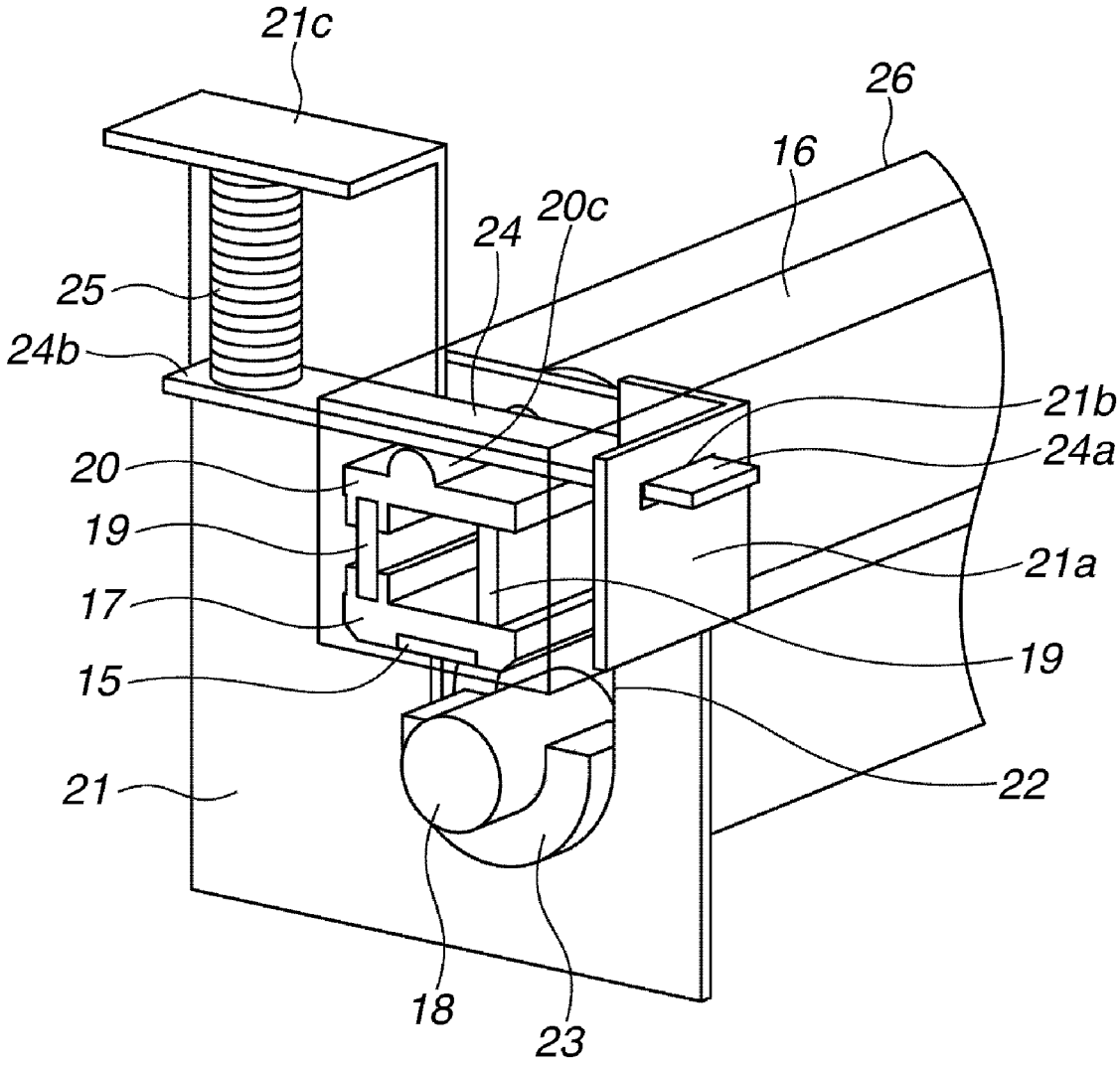
FIG. 10 is a perspective view of a heating fixing apparatus according to a second exemplary embodiment of the present invention.
Figure 11:
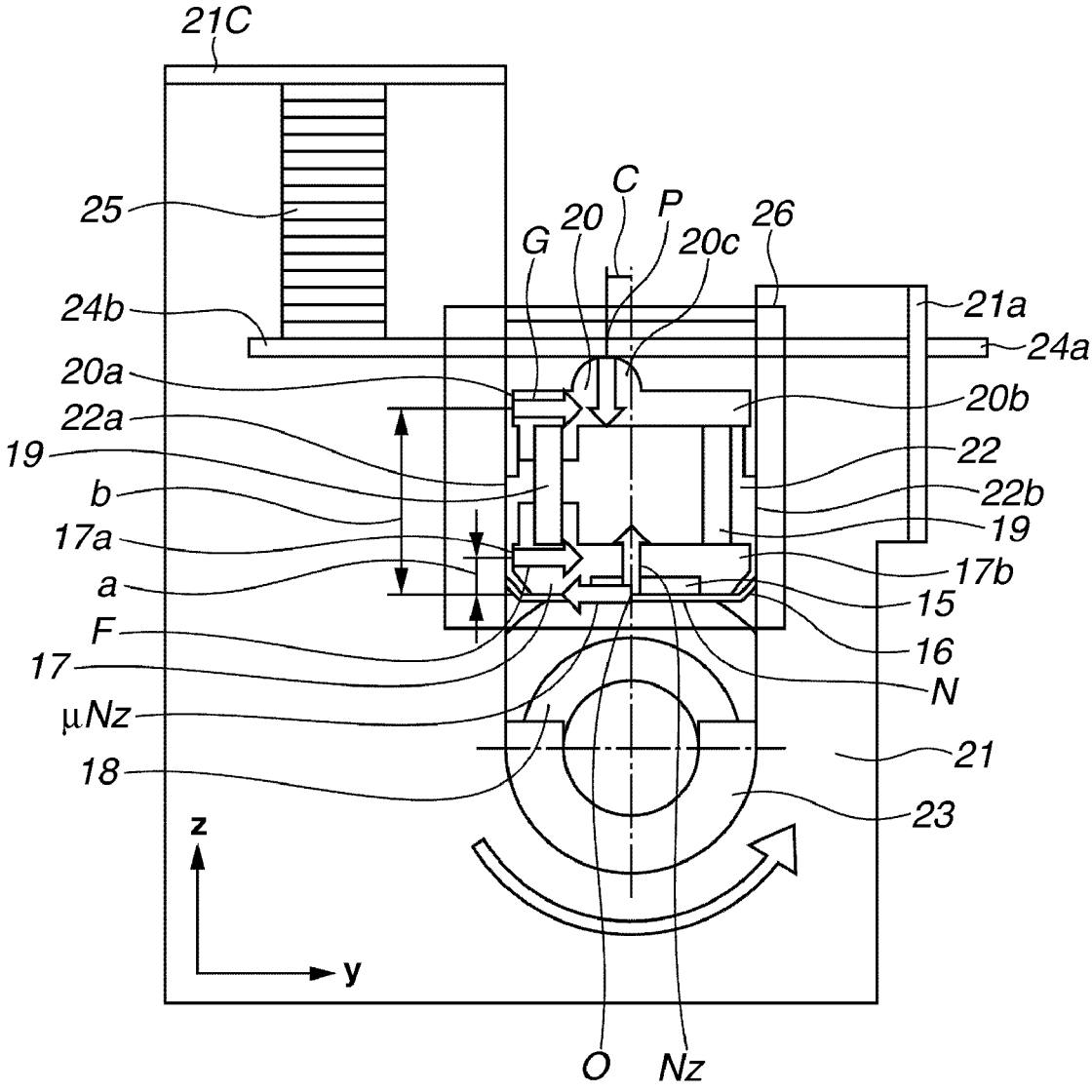
FIG. 11 is a side view of the heating fixing apparatus according to the second exemplary embodiment of the present invention.

FIGS. 10 and 11 are respectively a perspective view and a side view of a pressure portion for pressing a heater 15 against a pressure roller 18 of a heating fixing apparatus 2 to form a fixing nip N according to the second exemplary embodiment.

In the second exemplary embodiment, a pressure portion 20*c* of a flange 20 is located at a position shifted by a predetermined amount c, at the downstream side in a recording material conveying direction with respect to an imaginary line representing a normal line passing through the center of the fixing nip N (according to the present exemplary embodiment, the center of the pressure roller 18 is on the normal line). A normal line perpendicular to a pressure plate 24 at the contact point between the pressure plate 24 and the pressure portion 20*c* is parallel to a guide groove 22 of a fixing frame 21.

FIG. 11 illustrates the external forces acting on a heating unit 26 except a fixing film 16. Symbols used in FIG. 11 represent the following elements. The direction of a white arrow in FIG. 11 indicates the rotation direction of the pressure roller 18 while conveying the recording material (i.e., while performing fixing).

P: force with which the pressure plate 24 presses the pressure portion 20*c* of the flange 20.

$N_z$: drag (normal force) applied from the pressure roller 118.

F: drag (normal force) received by a downstream side opposite surface 17*a* of a lower fitting portion of the heating unit 26 from a downstream side rim 22*a* of the guide groove 22 (if F<0, drag (normal force) received by an upstream side opposite surface 17*b* of a lower fitting portion of the heating unit 26 from an upstream side rim 22*b* of the guide groove 22).

G: drag (normal force) received by a downstream side opposite surface 20*a* of an upper fitting portion of the heating unit 26 from the downstream side rim 22*a* of the guide groove 22 (if G<0, drag (normal force) received by the upstream side opposite surface 17*b* of a lower fitting portion of the heating unit 26 from the upstream side rim 22*b* of the guide groove 22).

μ: friction coefficient between the fixing film 16 and the heater 15.

a: distance from a fixing nip surface N to each of the lower fitting portions 17*a* and 17*b* of the heating unit 26.

b: distance from the fixing nip surface N to each of the upper fitting portions 20*a* and 20*b* of the heating unit 26.

c: distance between a straight line passing through the center O of the fixing nip N in parallel to the guide groove 22 and the normal perpendicular to the pressure plate 24 at the contact point between the pressure plate 24 and the pressure portion 20*c*.

The lower side of the heating unit 26 refers to the side of the pressure roller 18 along the direction of the guide groove 22. The upper side of the heating unit 26 refers to a side opposite to the lower side thereof. The upstream side and the downstream side of the heating unit 26 are determined with respect to the recording material conveying direction.

A balance equation of force acting in a z-direction (direction parallel to the guide groove 22), a balance equation of force acting in a y-direction (direction perpendicular to the guide groove 22), and a balance equation of rotation moment around a point (center of the fixing nip N) O are as follows.

Force acting in the $z$-direction: $P=N_z$

Force acting in the $y$-direction: $F+G=\mu N_z$

Rotation moment around the point $O$: $aF+bG=cP$

According to the above three equations, the drags (normal forces) F and G are obtained as follows.

$$F=P(\mu b-c)/(b-a).$$

$$G=P(c-\mu a)/(b-a).$$

In the present exemplary embodiment, a value of the friction coefficient μ is obtained by actual measurement. In addition, values of the distances a, b, and c are set so as to satisfy the following relationship thereamong, then F>0 and G>0 are satisfied.

$$\mu b>c>\mu a.$$

That is both of the downstream side opposite surface 17*a* of the lower fitting portion of the heater holder 17 of the heating unit 26 and the downstream side opposite surface 20*a* of the upper fitting portion of the flange 20 thereof abut against the downstream side rim 22*a* of the guide groove 22.

Accordingly, the position of the heating unit 26 is affected only by the dimensions of the downstream side opposite surface 17*a* of the lower fitting portion of the heating unit 26, the downstream side opposite surface 20*a* of the upper fitting portion thereof, and the downstream side rim 22*a* of the guide groove 22. Consequently, according to the present exemplary embodiment, the position of the heating unit 26 can be stabilized, as compared with that of the conventional heating unit 126. The influence of the position of the heating unit 26 on the fixability is similar to that described in the description of the first exemplary embodiment.

According to the present exemplary embodiment, the common normal line at the contact point between the pressure plate 24 and the pressure portion 20*c* is configured to be parallel to the guide groove 22 of the fixing frame 21. However, similar advantages can be obtained when a certain angle is formed between the normal line at the contact point and each rim of the guide groove 22, similarly to the first exemplary embodiment.

Thus, the image heating apparatus is constructed such that even when rotation moment is generated in the heating unit 26 by rotation of the pressure roller 18 in the recording material conveying direction, at least two points 17*a* and 20*a* in a region of the fitting portions opposed to the downstream side rim 22*a* in the recording material conveying direction of the guide groove 22 abut against the downstream side rim 22*a* of the of the guide groove 22. Accordingly, rotation moment whose magnitude is larger than that of rotation moment generated in the heating unit 26 by rotation of the pressure roller 18 in a direction, in which the recording material is conveyed, is applied to the heating unit 26 by the pressure member 24 in a direction, in which the rotation moment generated by rotation of the pressure roller 18 is cancelled.

Thus, according to the present exemplary embodiment, the influence of the dimension tolerance of the heating unit 26 and the fixing frame 21 serving as the heating unit support member for the heating unit 26 and the pressure roller 18 on the position of the heating unit 26 can be reduced. In addition, the position of the heating unit 26 can be stabilized.

Consequently, variation in the relative positions of the heater 15 and the fixing nip N of the heating unit 26 can be suppressed. In addition, fixing failures and image failures such as the cold offset and the hot offset, which occur due to such variation, can be reduced.

Next, a third exemplary embodiment of the present invention is described hereinafter. Similar to the second exemplary embodiment, the third exemplary embodiment differs from the aforementioned first exemplary embodiment only in the pressure portion of the heating fixing apparatus. Therefore, only the difference between the first exemplary embodiment and the third exemplary embodiment is mainly described below. The rest of the configuration of the third exemplary embodiment is similar to that of the first exemplary embodiment. In addition, components of the third exemplary embodiment, which are similar to those of the first exemplary embodiment, are designated with the same reference numerals. Thus, description of such components is omitted.

Figure 12:
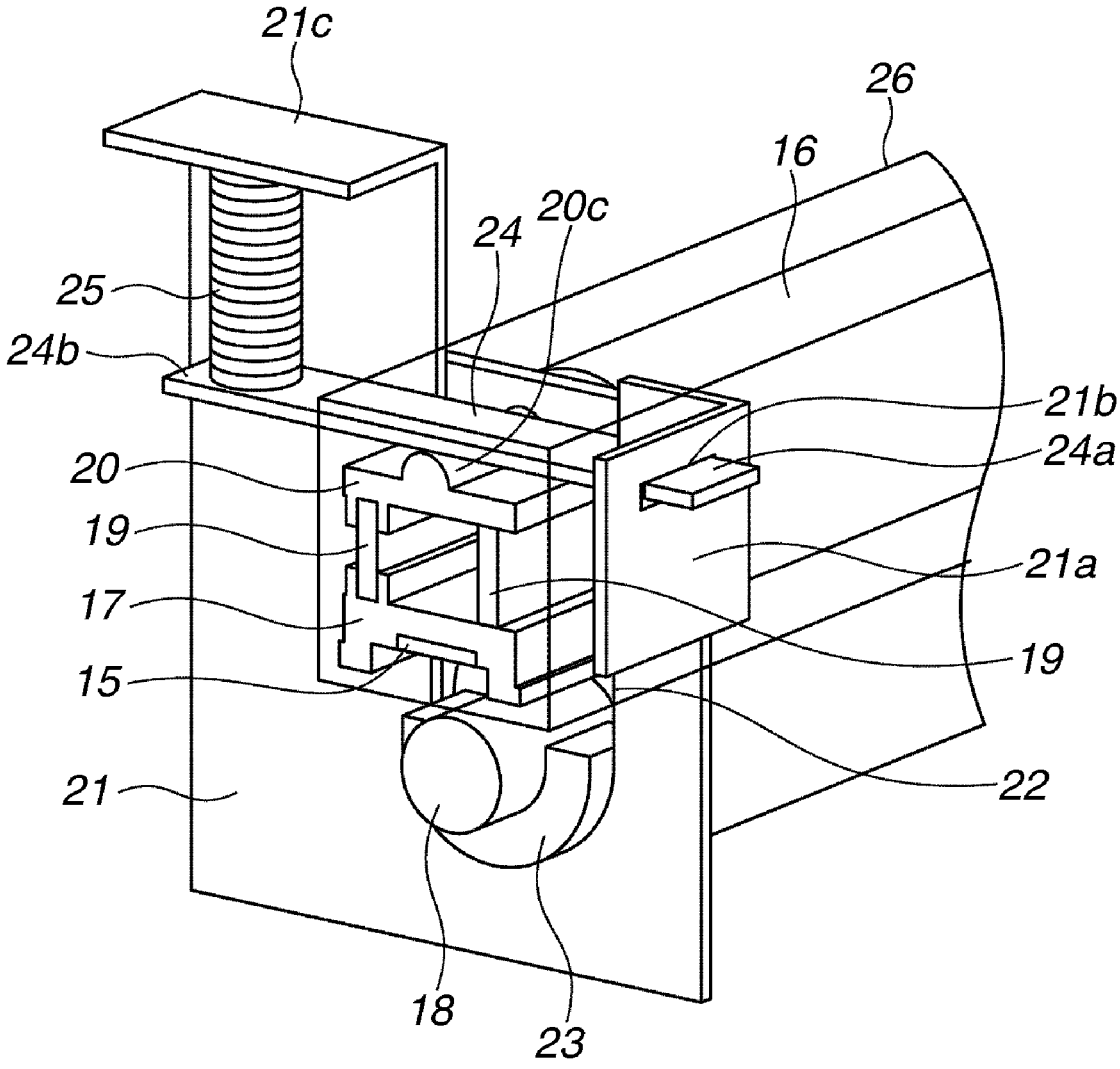
FIG. 12 is a perspective view of a heating fixing apparatus according to a third exemplary embodiment of the present invention.
Figure 13:
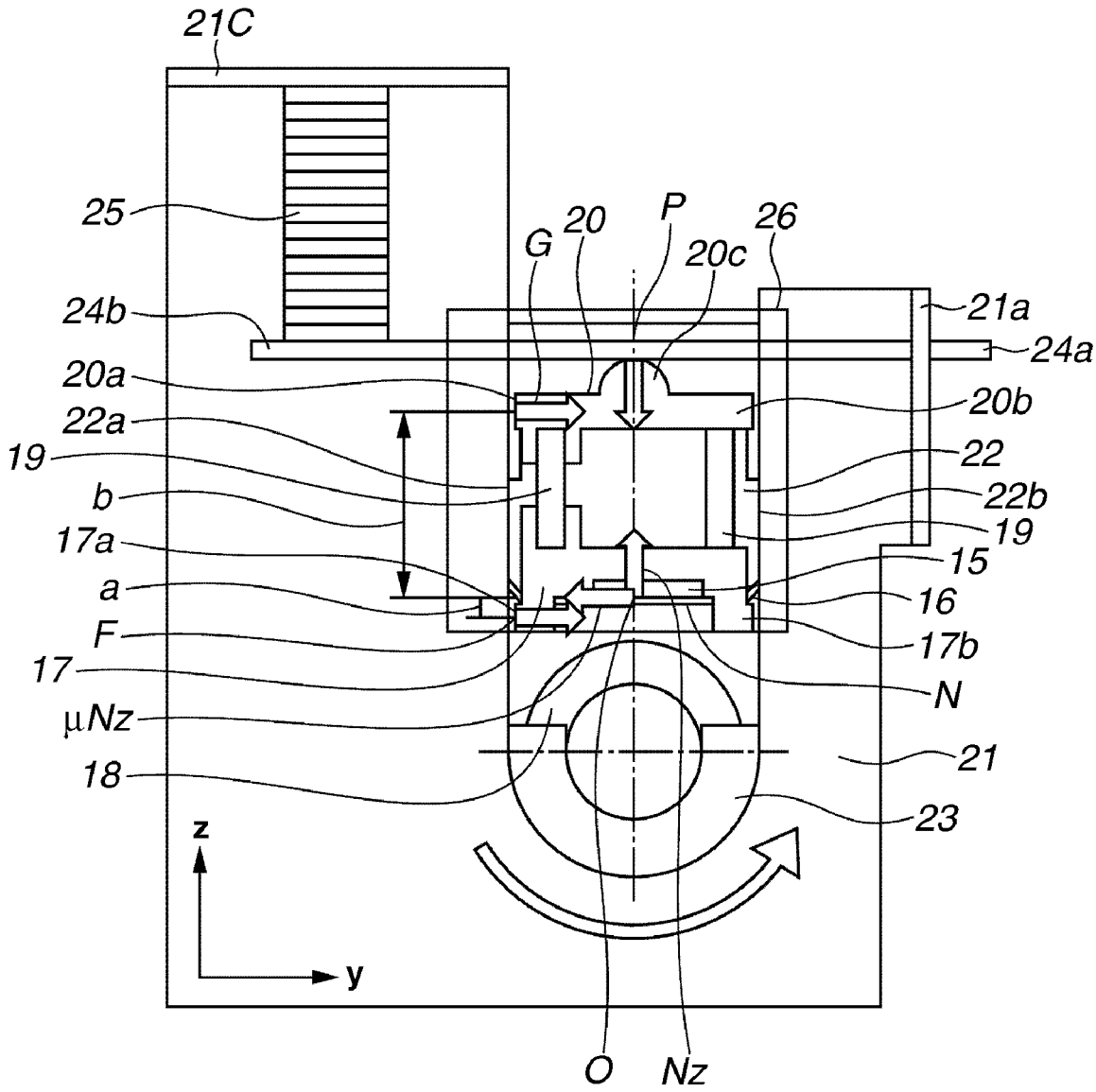
FIG. 13 is a side view of the heating fixing apparatus according to the third exemplary embodiment of the present invention.
Figure 14:
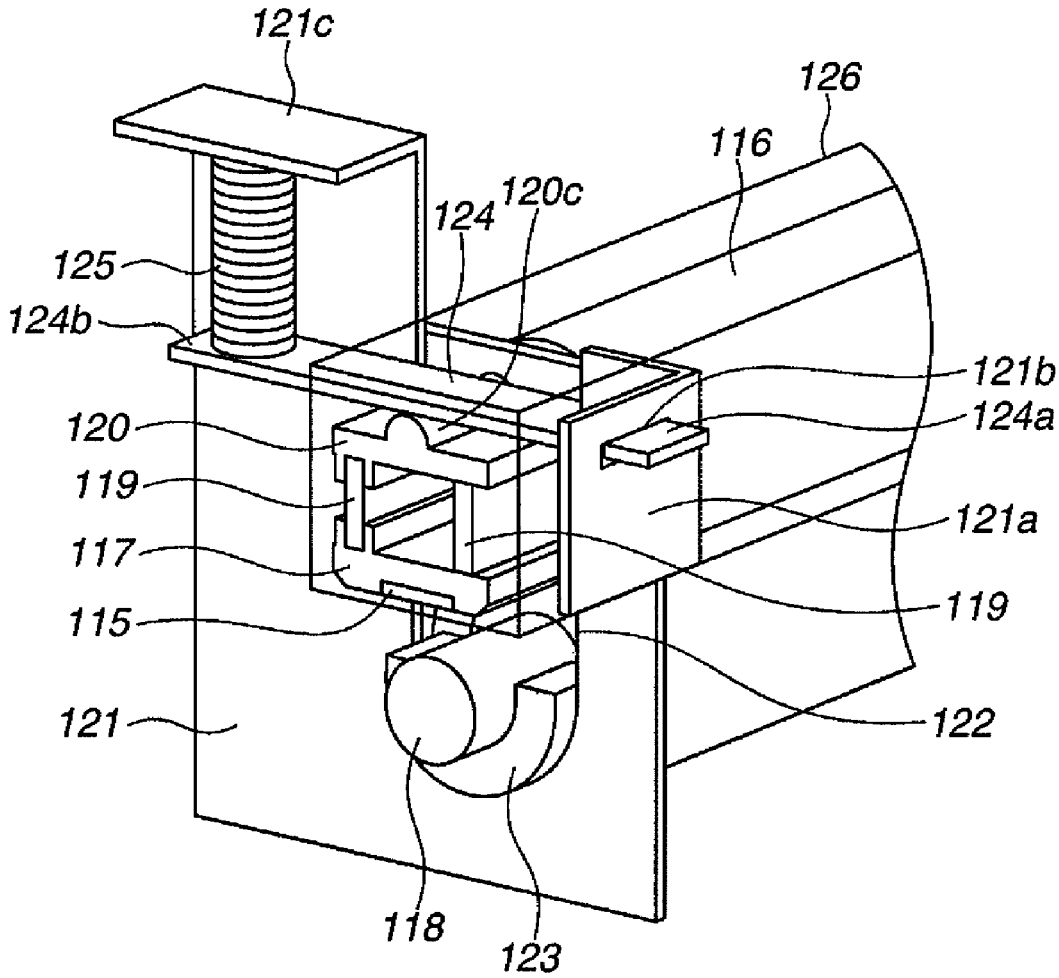
FIG.14 (PRIOR ART)
FIG. 14 is a perspective view of a related heating fixing apparatus.
Figure 15:
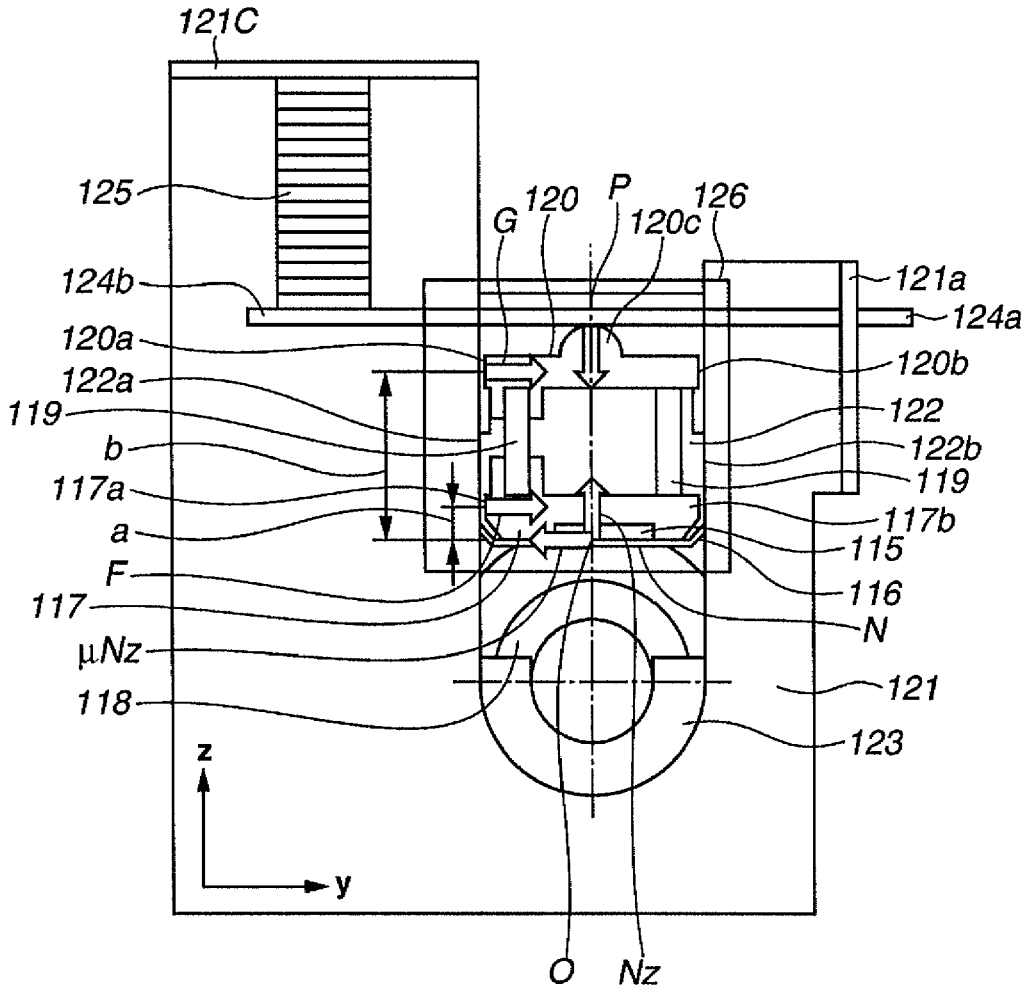
FIG.15 (PRIOR ART)
FIG. 15 is a side view of the related heating fixing apparatus.

FIGS. 12 and 13 are respectively a perspective view and a side view of a pressure portion for pressing a heater 15 against a pressure roller 18 of a heating fixing apparatus 2 according to the third exemplary embodiment to form a fixing nip N.

In the present exemplary embodiment, a downstream side opposite surface 17*a* and an upstream side opposite surface 17*b* of a lower fitting portion of the heating unit 26 is located closer to the pressure roller 18 than the fixing nip N. That is, the heating unit 26 includes a downstream side opposite surface 17*a* of a heater holder 17 provided in at least a region that is located at the side of the pressure roller 18 serving as the press-contact member and that is one of regions divided by a common tangent surface of the fixing nip N constituted by the heating unit 26 and the pressure roller 18. The downstream side opposite surface 17*a* engages with the downstream side rim 22*a* of the guide groove 22.

The pressure portion 20*c* of the flange 20 is located on a normal line perpendicular to a nip surface passing through the center of the fixing nip N (in the present exemplary embodiment, the center of the pressure roller 18 is located on this normal line). A normal line at a contact point between the pressure plate 24 and the pressure portion 20*c* is parallel to the guide groove 22 of the fixing frame 21.

FIG. 13 illustrates the external forces acting on the heating unit 26 except the fixing film 16. Symbols used in FIG. 13 represent the following elements. The direction of a white arrow in FIG. 13 is that of rotation of the pressure roller 18 while conveying the recording material (i.e., while performing fixing).

P: force with which the pressure plate 24 presses the pressure portion 20*c* of the flange 20.

$N_z$: drag (normal force) applied from the pressure roller 118.

F: drag (normal force) received by the downstream side opposite surface 17*a* of the lower fitting portion of the heating unit 26 from the downstream side rim 22*a* of the guide groove 22 (if F<0, drag (normal force) received by the upstream side opposite surface 17*b* of the lower fitting portion of the heating unit 26 from the upstream side rim 22*b* of the guide groove 22).

G: drag (normal force) received by the downstream side opposite surface 20*a* of the upper fitting portion of the heating unit 26 from the downstream side rim 22*a* of the guide groove 22 (if G<0, drag (normal force) received by the upstream side opposite surface 17*b* of the lower fitting portion of the heating unit 26 from the upstream side rim 22*b* of the guide groove 22).

μ: friction coefficient between the fixing film 16 and the heater 15.

a: distance from a fixing nip surface N to each of the lower fitting portions 17*a* and 17*b* of the heating unit 26.

b: distance from the fixing nip surface N to each of the upper fitting portions 20*a* and 20*b* of the heating unit 26. The lower side of the heating unit 26 refers to the side of the pressure roller 18 along the direction of the guide groove 22.

The upper side of the heating unit 26 is a side opposite to the lower side thereof. The upstream side and the downstream side of the heating unit 26 are determined with respect to the recording material conveying direction.

A balance equation of force acting in a z-direction (direction parallel to the guide groove 22), a balance equation of force acting in a y-direction (direction perpendicular to the guide groove 22), and a balance equation of rotation moment around a point (center of the fixing nip N) O are as follows.

Force acting in the $z$-direction: $P=N_z$

Force acting in the $y$-direction: $F+G=\mu N_z$

Rotation moment around the point $O$: $-aF+bG=0$

According to the above three equations, the drags (normal forces) F and G are obtained as follows.

$$F=\mu bP/(a+b)>0$$

$$G=\mu aP/(a+b)>0.$$

That is, both of the downstream side opposite surface 17*a* of the lower fitting portion of the heating unit 26 and the downstream side opposite surface 20*a* of the upper fitting portion thereof abut against the downstream side rim 22*a* of the guide groove 22.

Accordingly, the position of the heating unit 26 is affected only by the dimensions of the downstream side opposite surface 17*a* of the lower fitting portion of the heating unit 26, the downstream side opposite surface 20*a* of the upper fitting portion thereof, and the downstream side rim 22*a* of the guide groove 22. Consequently, according to the present invention, a stable position of the heating unit 26 can be maintained, as compared with that of the conventional heating unit 126. The influence of the position of the heating unit 26 on the fixability is similar to that described in the description of the first exemplary embodiment.

According to the present exemplary embodiment, the common normal line at the contact point between the pressure plate 24 and the pressure portion 20*c* is configured to be parallel to the guide groove 22 of the fixing frame 21. However, similar advantages can be obtained when a certain angle is formed between the normal at the contact point and each rim of the guide groove 22, similarly to the first exemplary embodiment.

In addition, according to the present exemplary embodiment, the normal line at the contact point between the pressure plate 24 and the pressure portion 20*c* is configured to be located on a normal line perpendicular to a nip surface passing through the center of the fixing nip N (the center of the pressure roller 18 in the present exemplary embodiment). However, similar advantages can be obtained by a configuration in which the normal line at the contact point is shifted from the normal line perpendicular to the nip surface.

Thus, the image heating apparatus is constructed such that even when rotation moment is generated in the heating unit 26 by rotation of the pressure roller 18 in the recording material conveying direction, at least two points 17*a* and 20*a* in a region of the fitting portions opposed to the downstream side rim 22*a* in the recording material conveying direction of the guide groove 22 abut against the downstream side rim 22*a* of the of the guide groove 22. Accordingly, rotation moment whose magnitude is larger than that of rotation moment generated in the heating unit 26 by rotation of the pressure roller 18 in a direction, in which the recording material is conveyed, is applied to the heating unit 26 by the pressure member 24 in a direction, in which the rotation moment generated by rotation of the pressure roller 18 is cancelled.

Thus, according to the third exemplary embodiment, the influence of the dimension tolerance of the heating unit 26 and the fixing frame 21 serving as the heating unit support member for the heating unit 26 and the pressure roller 18 on the position of the heating unit 26 can be reduced. In addition, the position of the heating unit 26 can be stabilized.

Consequently, variation in the relative positions of the heater 15 and the fixing nip N of the heating unit 26 can be suppressed. In addition, fixing failures and image failures such as the cold offset and the hot offset, which occur due to such variation, can be reduced.

In the foregoing description of each of the exemplary embodiments, the image heating apparatuses according to the present exemplary embodiment have been described by taking the heating fixing apparatuses for heat-fixing toner images as examples. However, the image heating apparatus according to the present invention is not limited to the heating fixing apparatus. The present invention can be applied widely to, e.g., a gloss-imparting apparatus for imparting gloss to a recording material to which an image is fixed.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-198369 filed Jul. 31, 2008, which is hereby incorporated by reference herein in its entirety.

What is claimed is:

1. An image heating apparatus for heating a recording material that bears a toner image, the image heating apparatus comprising:

a heating unit including a flexible sleeve configured to contact the toner image, and a heater configured to be in contact with an inner surface of the sleeve;

a pressure roller forming a nip portion that sandwiches and conveys the recording material, in cooperation with the heater via the sleeve;

a frame configured to hold the heating unit and the pressure roller, and including a guide groove that guides the heating unit towards the pressure roller held by the frame, wherein the guide groove guides each of fitting portions respectively provided at both ends of the heating unit along a rim of the guide groove; and a pressure member configured to press the heating unit toward the pressure roller, wherein a width of the guide groove in a recording material conveying direction is wider than that of each of the fitting portions in the recording material conveying direction, and wherein rotation moment whose magnitude is larger than that of rotation moment generated in the heating unit by rotation of the pressure roller in a direction, in which the recording material is conveyed, is applied to the heating unit by the pressure member in a direction, in which the rotation moment generated by rotation of the pressure roller is cancelled, so that even when the rotation moment is generated by the rotation of the pressure roller, at least two points in a region of the fitting portions opposed to a downstream side rim in the recording material conveying direction of the guide groove abut against the downstream side rim.

2. The image heating apparatus according to claim 1, wherein the heating unit has a pressure portion against which the pressure member abuts, and wherein the pressure portion is protruded, and the pressure portion is provided at a position at a downstream side in the recording material conveying direction with respect to a center of the nip portion in the recording material conveying direction.

3. The image heating apparatus according to claim 1, wherein at least one point of the fitting portions that contact the downstream side rim in the recording material conveying direction of the guide groove is provided in a zone closer to the side of the pressure roller with reference to a virtual surface including a surface of the heater in contact with the flexible sleeve.

* * * * *